US008998007B1

(12) United States Patent
Grossmann

(10) Patent No.: US 8,998,007 B1
(45) Date of Patent: Apr. 7, 2015

(54) SNOW SKI, SNOWBOARD AND ACCESSORY STORAGE DEVICE

(76) Inventor: Peter Burns Grossmann, Ashland, OR (US)

( * ) Notice: Subject to any disclaimer, the term of this patent is extended or adjusted under 35 U.S.C. 154(b) by 0 days.

(21) Appl. No.: 13/553,704

(22) Filed: Jul. 19, 2012

Related U.S. Application Data

(60) Provisional application No. 61/606,508, filed on Mar. 5, 2012.

(51) Int. Cl.

| | |
|---|---|
| ***A47F 7/00*** | (2006.01) |
| ***A47B 81/00*** | (2006.01) |
| *A47H 1/00* | (2006.01) |
| *A47F 5/08* | (2006.01) |
| *A47G 25/06* | (2006.01) |
| *D06F 57/12* | (2006.01) |

(52) U.S. Cl.
CPC . *A47B 81/00* (2013.01); *A47F 5/08* (2013.01); *A47G 25/0685* (2013.01); *D06F 57/12* (2013.01)

(58) Field of Classification Search
CPC ..... D06F 57/12; A47B 81/00; A47F 5/08; A47G 25/0685
USPC ..... 211/85.7, 60.1, 89.01, 70.5, 85.31, 211/70.6, 106.01, 106, 96, 100, 119, 211/119.004; 248/110, 304, 308, 339
See application file for complete search history.

(56) References Cited

U.S. PATENT DOCUMENTS

| | | | | | |
|---|---|---|---|---|---|
| 482,869 | A | * | 9/1892 | Huber et al. | 211/100 |
| 821,364 | A | * | 5/1906 | Jessel | 211/89.01 |
| 1,159,192 | A | * | 11/1915 | Dudley | 211/119.1 |
| 1,208,986 | A | * | 12/1916 | Krodel | 248/282.1 |
| 1,493,294 | A | * | 5/1924 | Timberlake | 223/75 |
| 2,051,408 | A | * | 8/1936 | Karst | 211/65 |
| 2,147,172 | A | * | 2/1939 | Poole | 211/99 |
| 2,149,908 | A | * | 3/1939 | Poole | 211/89.01 |
| 2,222,831 | A | * | 11/1940 | Bitney | 248/91 |
| 2,919,032 | A | | 12/1959 | Sinawski | |
| 2,956,812 | A | | 10/1960 | Lundquist | |
| 3,330,573 | A | | 7/1967 | Sieloff | |
| 3,570,681 | A | | 3/1971 | Kinshofer | |
| 3,746,355 | A | | 7/1973 | Holley | |
| 4,222,490 | A | | 9/1980 | Wood, Jr. | |
| 4,330,065 | A | * | 5/1982 | Haddad | 211/70.5 |
| 4,763,797 | A | | 8/1988 | Egan | |
| 5,307,944 | A | | 5/1994 | Reedy | |
| 5,417,335 | A | | 5/1995 | White | |
| 5,813,550 | A | * | 9/1998 | Sheehan et al. | 211/87.01 |
| 5,884,781 | A | | 3/1999 | Ehrhart | |
| 6,045,100 | A | * | 4/2000 | Shields | 248/222.51 |

(Continued)

*Primary Examiner* — Jonathan Liu
*Assistant Examiner* — Devin Barnett
(74) *Attorney, Agent, or Firm* — Jerry Haynes Law

(57) ABSTRACT

A snow ski, snow board and accessory storage device includes a backing plate; a hinge assembly carried by the backing plate, the hinge assembly including at least one hinge rotatable with respect to the backing plate; at least one backing arm carried by the at least one hinge of the hinge assembly, the at least one backing arm having an outer arm segment and an inner arm segment spaced-apart and parallel to the outer arm segment; the at least one backing arm adapted to receive a snow ski or snowboard between the outer arm segment and the inner arm segment; and a spreader and hanging bar carried by the backing plate, the at least one backing arm normally resting by gravity against the spreader and hanging bar and capable of being raised from the spreader and hanging bar as the at least one hinge rotates relative to the backing plate.

20 Claims, 7 Drawing Sheets

(56) References Cited

U.S. PATENT DOCUMENTS 6,886,795 B2 * 5/2005 Schultz ..... 248/316.2
7,896,175 B1 * 3/2011 Corr et al. ..... 211/86.01
2009/0020487 A1 1/2009 Wood
2010/0213346 A1 * 8/2010 Chen ..... 248/693

* cited by examiner

SNOW SKI, SNOWBOARD AND ACCESSORY STORAGE DEVICE

CROSS-REFERENCE TO RELATED APPLICATIONS

This application claims the benefit of U.S. provisional application No. 61/606,508, filed Mar. 5, 2012 and entitled SNOW SKI, SNOWBOARD, AND ACCESSORY STORAGE DEVICE, which provisional application is hereby incorporated by reference herein in its entirety.

FIELD OF THE INVENTION

Illustrative embodiments of the disclosure generally relate to devices for storing snow skis, snowboards, ski and snowboard accessories and the like. More particularly, illustrative embodiments of the disclosure relate to a snow ski, snowboard and accessory storage device which facilitates storage of snow skis, snowboards and ski and snowboard accessories without altering the camber or shape of the skis or snowboard, in addition to facilitating the storage of an individual snow ski, or snowboard.

BACKGROUND OF THE INVENTION

Conventional devices for storing snow skis, snowboards and ski and snowboard accessories typically utilize the traditional shape and camber of the snow skis and snowboards to hold the snow skis and snowboards in the device. Conventional storage devices typically require that the snow skis and/or snowboards be compressed together and stored as a pair. Unlike snow skis, which are typically used in tandem, a snowboard is individually used, and as such, cannot be stored in conventional storage devices which require the compression of two objects in order to retain them. In addition, the compression of the snow skis or snowboards alters their natural shape and camber and may permanently alter the shape and camber of snow skis and snowboards in a detrimental way. Moreover, recent advances in snow ski and snowboard fabrication technology have drastically and fundamentally changed the shape and camber of snow skis and snowboards. Due to the non-traditional shape of the newer snow skis and snowboards, the change in camber imparted by the conventional storage devices on the newer snow skis and snowboards may occur at a higher magnitude than on the older, traditionally shaped skis and snowboards.

Accordingly, a snow ski, snowboard and accessory storage device which facilitates the individual storage of snow skis, snowboards and ski and snowboard accessories without altering the camber or shape of the skis or snowboards may be desirable for some applications.

SUMMARY OF THE INVENTION

The disclosure is generally directed to a snow ski, snowboard and accessory storage device which facilitates storage of snow skis, snowboards and ski and snowboard accessories without altering the camber or shape of the skis or snowboard. An illustrative embodiment of the device includes a backing plate; a hinge assembly carried by the backing plate, the hinge assembly including at least one hinge rotatable with respect to the backing plate; at least one backing arm carried by the at least one hinge of the hinge assembly, the at least one backing arm having an outer arm segment and an inner arm segment spaced-apart and parallel to the outer arm segment; the at least one backing arm adapted to receive a snow ski or snowboard between the outer arm segment and the inner arm segment; and a spreader and hanging bar carried by the backing plate, the at least one backing arm normally resting by gravity against the spreader and hanging bar and capable of being raised from the spreader and hanging bar as the at least one hinge rotates relative to the backing plate.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
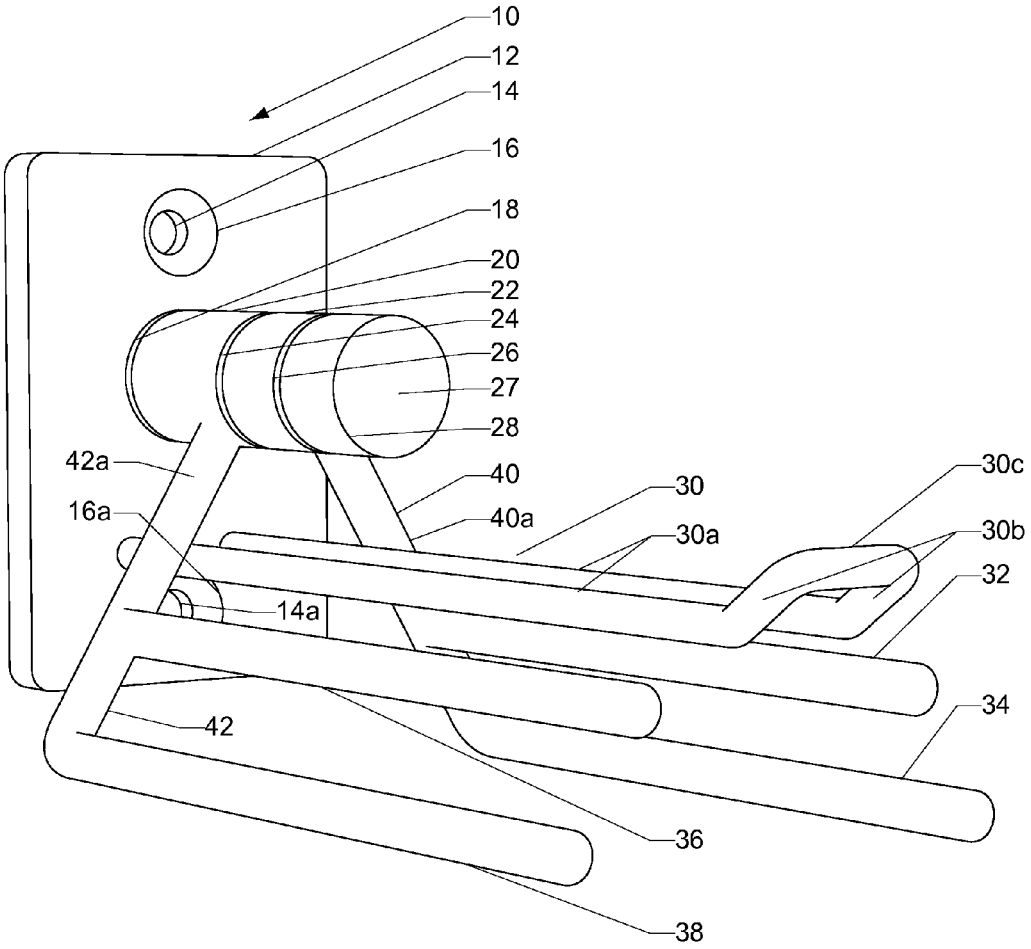
FIG. 1 is a perspective view of an illustrative embodiment of a snow ski, snowboard and accessory storage device.
Figure 2:
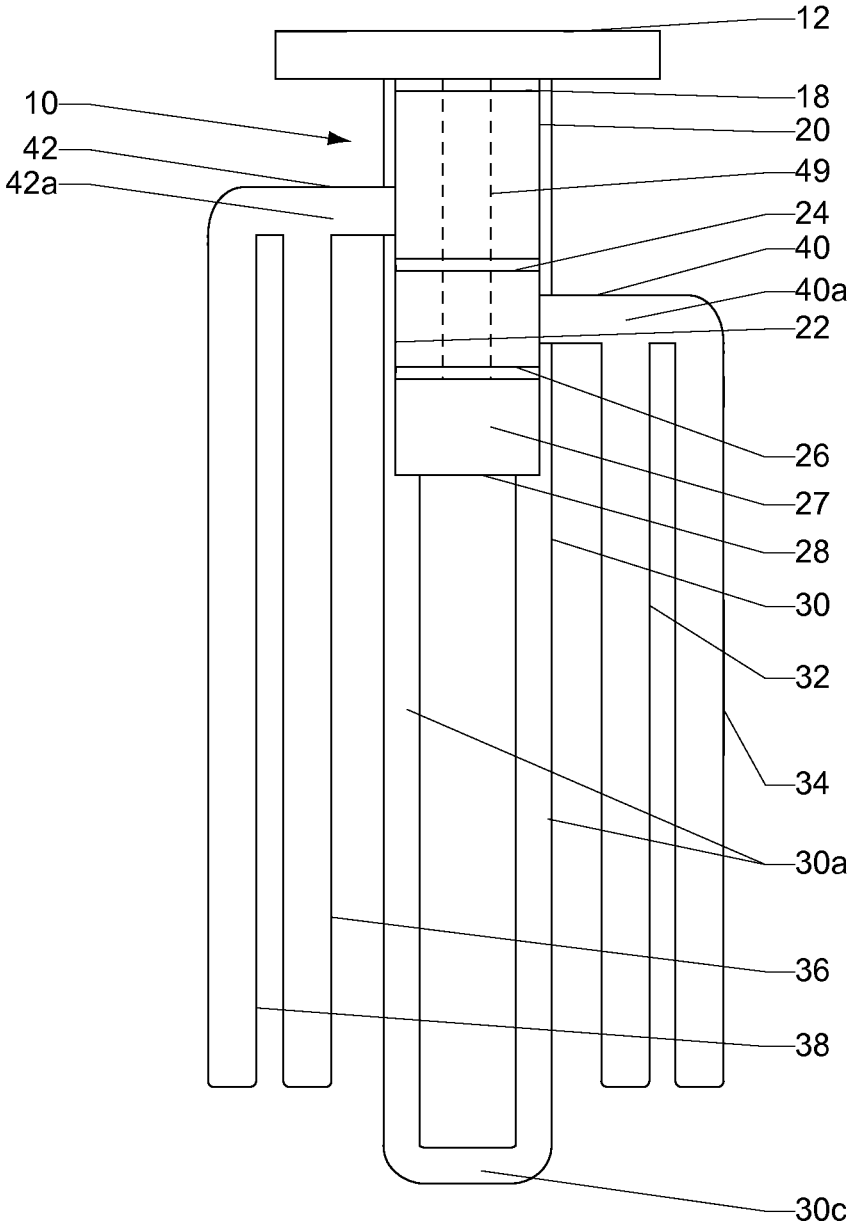
FIG. 2 is a top view of an illustrative snow ski, snowboard and accessory storage device.
Figure 3:
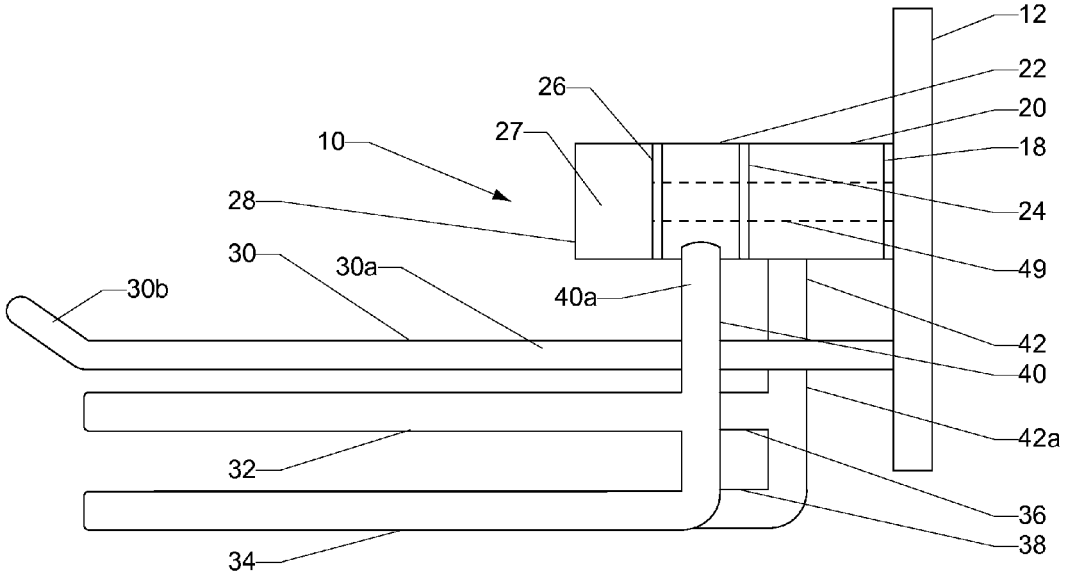
FIG. 3 is a right side view of an illustrative snow ski, snowboard and accessory storage device.

Referring initially to FIGS. 1-3 of the drawings, an illustrative embodiment of the snow ski, snowboard and accessory storage device, hereinafter device, is generally indicated by reference numeral 10. The device 10 may include a backing plate 12 which facilitates attachment of the device 10 to a vertical support surface (not illustrated) using mechanical fasteners (not illustrated) and/or other suitable attachment technique. In some embodiments, fastener openings 14, 14*a* may extend through the backing plate 12. The fastener openings 14, 14*a* are sized and configured to receive a mechanical fasteners (not illustrated) which facilitates attachment of the backing plate 12 to the vertical support surface. The fastener openings 14, 14*a* may be countersunk 16, 16*a*. The backing plate 12 may be metal, plastic, composite or other suitable material.

A hinge assembly 28 is provided on the backing plate 12. As illustrated in FIGS. 2 and 3, the hinge assembly 28 may include an elongated hinge shaft 49 which extends from the backing plate 12. An inner washer 18 may be provided on the hinge shaft 49 and may abut against the surface of the backing plate 12. At least one hinge 20, 22 is rotatably mounted relative to the backing plate 12. In some embodiments, a cylindrical inner hinge 20 has an inner hinge bore (not illustrated) which receives the hinge shaft 49 to rotatably mount the inner hinge 20 on the hinge shaft 49. The inner hinge 20 may abut against the inner washer 18. A middle washer 24 may be provided on the hinge shaft 49 adjacent to the inner hinge 20. An outer hinge 22 has an outer hinge bore (not illustrated) which receives the hinge shaft 49 to rotatably mount the outer hinge 22 on the hinge shaft 49. The outer hinge 22 may abut against the middle washer 24. An outer washer 26 may receive the hinge shaft 49 and may abut against the outer hinge 22. A hinge cap 27 may be attached to the extending or distal end of the hinge shaft 49. The hinge cap 27 may be welded, threaded, cast or otherwise attached to the hinge shaft 49 according to the knowledge of those skilled in the art. The hinge cap 27 may abut against the outer washer 26. Accordingly, the inner hinge 20 and the outer hinge 22 are independently rotatable with respect to the backing plate 12.

A spreader and hanging bar 30 extends from the backing plate 12 generally beneath the hinge assembly 28. The spreader and hanging bar 30 may include a pair of generally elongated, parallel, spaced-apart main bar segments 30*a* which extend from the backing plate 12. The main bar segments 30*a* may be welded, threaded, cast or otherwise attached to the backing plate 12 according to the knowledge of those skilled in the art. As illustrated in FIGS. 1 and 3, a terminal bar segment 30*b* may angle upwardly from the distal end of each main bar segment 30*a*. A transverse bar segment 30*c* may connect the terminal bar segments 30*b*. In application of the device 10, which will be hereinafter described, the spreader and hanging bar 30 may function as a location from which accessories such as snow ski poles, gloves, snow goggles, and similar objects can be suspended for storage.

Figure 4:
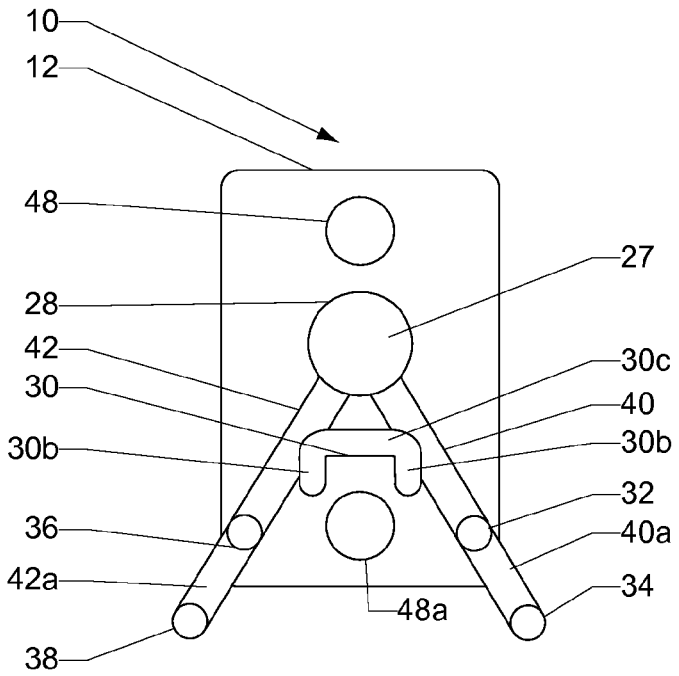
FIG. 4 is a front view of an illustrative snow ski, snowboard and accessory storage device, more particularly deployed in a resting position.

A first backing arm 40 is supported by the outer hinge 22 of the hinge assembly 28. The first backing arm 40 may include a generally elongated first main arm segment 40*a* which extends outwardly from the outer hinge 22. A first outer arm segment 34 may extend forwardly from the first main arm segment 40*a*, in generally perpendicular relationship to a longitudinal axis of the first main arm segment 40*a* and in generally parallel relationship to a longitudinal axis of the hinge assembly 28. An elongated first inner arm segment 32 may extend from the first main arm segment 40*a* in generally parallel, spaced-apart relationship to the first outer arm segment 34. Because the outer hinge 22 rotates relative to the hinge shaft 49 (FIG. 2) of the hinge assembly 28, the first backing arm 40 can be selectively lifted to the raised position illustrated in FIG. 6 or released to rest against the spreader and hanging bar 30 by gravity, as illustrated in FIG. 4.

The first inner arm segment 32 may be located in proximity to the first outer arm segment 34 of the first backing arm 40 such that the space between the first inner arm segment 32 and the first outer arm segment 34 is sufficiently wide to accommodate the thickness of a snow ski or snowboard. For example and without limitation, in some embodiments the space between the first inner arm segment 32 and the first outer arm segment 34 may be approximately 0.25 inches to 0.75 inches. The first outer arm segment 34 and the first inner arm segment 32 may extend so that their length provides ample bearing surfaces for the top and bottom surfaces of a snow ski or snowboard (not illustrated), which in some embodiments may be approximately 3~10 inches.

A second backing arm 42 is supported by the inner hinge 20 of the hinge assembly 28. The second backing arm 42 may have a design which is the same as or similar to the first backing arm 40. A generally elongated second main arm segment 42*a* may extend outwardly from the inner hinge 20. A second outer arm segment 38 may extend forwardly from the second main arm segment 42*a*, in generally perpendicular relationship to a longitudinal axis of the second main arm segment 42*a* and in generally parallel relationship to a longitudinal axis of the hinge assembly 28. An elongated second inner arm segment 36 may extend from the second main arm segment 42*a* in generally parallel, spaced-apart relationship to the second outer arm segment 38. Because the inner hinge 20 rotates relative to the hinge shaft 49 (FIG. 2) of the hinge assembly 28, the second backing arm 42 can be selectively lifted to the raised position illustrated in FIG. 5 or released to rest against the spreader and hanging bar 30 by gravity, as illustrated in FIG. 4.

The second inner arm segment 36 may be located in proximity to the second outer arm segment 38 of the second backing arm 42 such that the space between the second inner arm segment 36 and the second outer arm segment 38 is sufficiently wide to accommodate the thickness of a standard or conventional snow ski or snowboard. For example and without limitation, in some embodiments the space between the second inner arm segment 36 and the second outer arm segment 38 may be approximately 0.25 inches to 0.75 inches. The second outer arm segment 38 and the second inner arm segment 36 may extend so that their length provides ample bearing surfaces for the top and bottom surfaces of a snow ski or snowboard (not illustrated), which in some embodiments may be approximately 3~10 inches.

As the first backing arm 40 and the second backing arm 42 pivot via the hinge assembly 28, the back washer 18, the middle washer 24 and the outer washer 26 minimize friction and rubbing between the outer hinge 22 and the inner hinge 20 and between the hinge cap 27 and the outer hinge 22. The first main arm segment 40*a* and the first outer arm segment 34 thereof may be fabricated from a continuous length of rod and attached to the outer hinge 22. Similarly, the second main arm segment 42*a* and second outer arm segment 38 thereof may be fabricated from a continuous length of rod and attached to the inner hinge 20.

The spreader and hanging bar 30 may be sufficiently wide to separate the first backing arm 40 from the second backing arm 42. This expedient facilitates easy handling by a user when storing or removing snow skis or snowboards on the first backing arm 40 and/or the second backing arm 42. In some embodiments, the spreader and hanging bar 30 may extend slightly past or beyond the ends of the first inner arm segment 32 and the first outer arm segment 34 of the first backing arm 40 and beyond the ends of the second inner arm segment 36 and the second outer arm segment 38 of the second backing arm 42 to provide easier access for the hanging of accessories from the spreader and hanging bar 30 and may be a distance of approximately 4-11 inches in some embodiments.

Referring now to FIG. 4 of the drawings, an illustrative embodiment of the device 10 having a mechanical fasteners 48, 48*a* attaching the device 10 to a wall or other vertical support surface (not illustrated) is shown. The mechanical fasteners 48, 48*a* may be extended through the fastener openings 14, 14*a* (FIG. 1) in the backing plate 12 and threaded into a registering fastener opening (not illustrated) in the vertical support surface. As further illustrated in FIG. 4, the first backing arm 40 and the second backing arm 42 normally rest on the spreader and hanging bar 30 via gravity.

Figure 5:
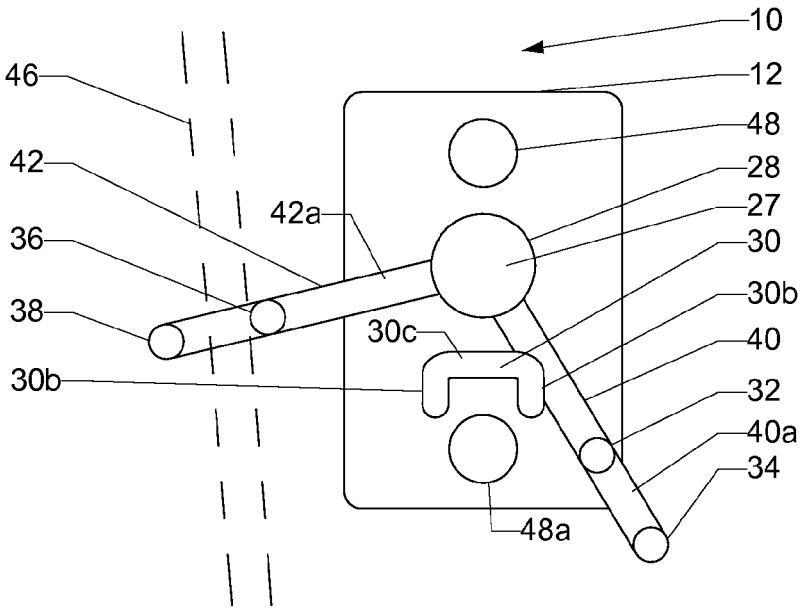
FIG. 5 is a front view of an illustrative snow ski, snowboard and accessory storage device, more particularly illustrating placement of a first snow ski (illustrated in phantom) in a support position on a second backing arm of the device.
Figure 6:
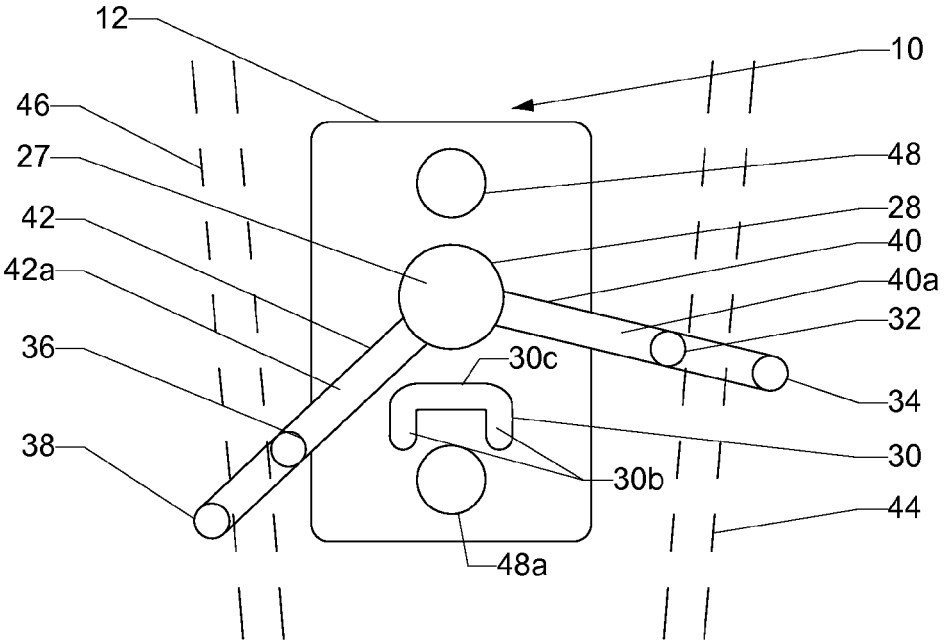
FIG. 6 is a front view of an illustrative snow ski, snowboard and accessory storage device, with the second backing arm deployed in a engaged position and more particularly illustrating placement of a second snow ski (illustrated in phantom) in a support position on a first backing arm of the device.

Referring next to FIGS. 5 and 6 of the drawings, in exemplary application of the device 10, a first snow ski 46 (illustrated in phantom) can initially be placed between the second inner arm segment 36 and the second outer arm segment 38 of the second backing arm 42 with the bottom surface of the first snow ski 46 in contact with the second inner arm segment 36, as illustrated in FIG. 6. The first snow ski 46 is oriented vertically as the lower (rear) end of the first snow ski 46 is inserted between and then contacts the second inner arm segment 36 and the second outer arm segment 38. The first snow ski 46 can then be raised, causing the second backing arm 38, via contact of the first snow ski 46 with the second inner arm segment 36 and the second outer arm segment 38, to pivot up and around the hinge pin 28.

As illustrated in FIG. 6, the first snow ski 46 may then be lowered until the second backing arm 42 pivots down and around the hinge pin 28. At that point, the first snow ski 46 is held in place between the second inner arm segment 36 and the second outer arm segment 38. The edge of the first snow ski 46 may contact the second main arm segment 42*a* of the second backing arm 42. The friction between the first snow ski 46 and the second inner arm segment 36, the second outer arm segment 38 and the second main arm segment 42*a* creates sufficient force between the first snow ski 46 and those respective surfaces of the second backing arm 42 to retain the first snow ski 46 in the device 10.

The first snow ski 46 can be selectively removed from the second backing arm 42 as desired by raising the first snow ski 46 such that the second backing arm 42 pivots upwardly around the hinge assembly 28 and the first snow ski 46 disengages the second inner arm segment 36 and the second outer arm segment 38. The first snow ski 46 can then be lifted from between the second inner arm segment 36 and the second outer arm segment 38.

Figure 7:
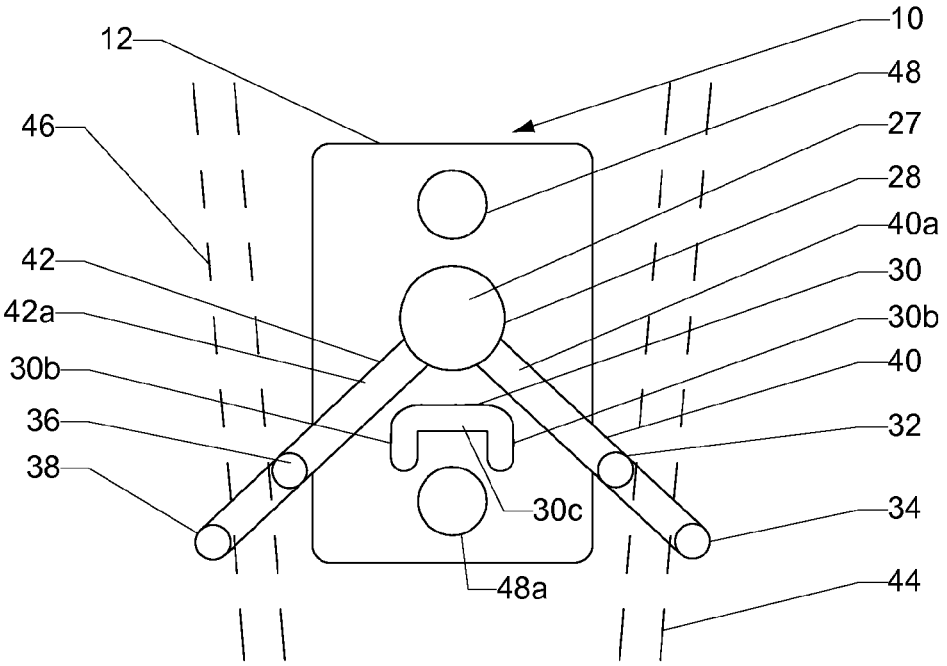
FIG. 7 is a front view of an illustrative snow ski, snowboard and accessory storage device, with the snow skis supported by the backing arms, respectively, of the device, and the backing arms deployed in a engaged position.

Referring next to FIG. 7 of the drawings, a second snow ski 44 can be selectively supported by the first backing arm 40 of the device 10 in a similar manner. The second snow ski 44 can be placed in the first backing arm 40 and selectively removed from the first backing arm 40 in the same manner as was heretofore described with respect to placement of the first snow ski 46 in the second backing arm 42.

Figure 8:
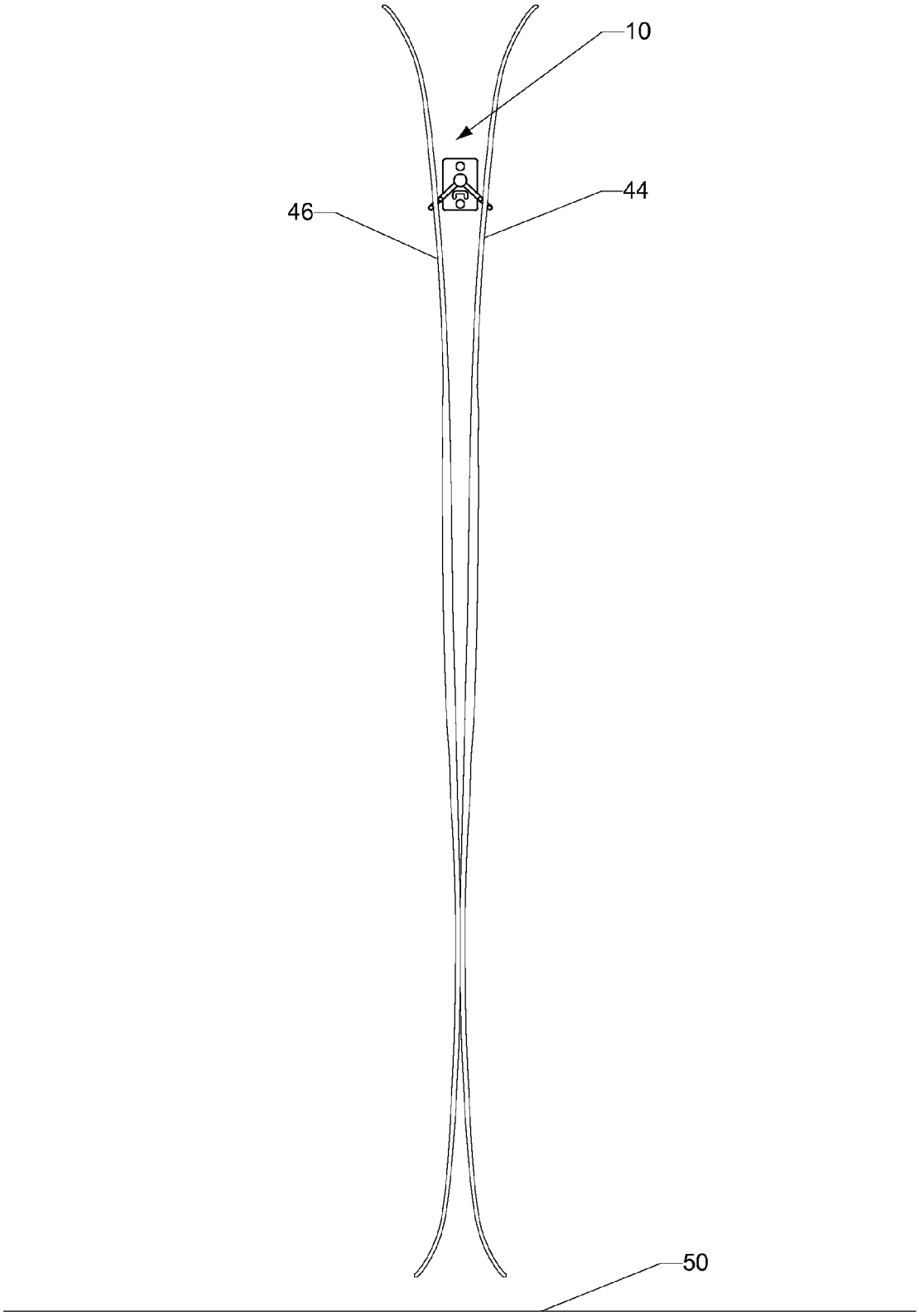
FIG. 8 is a front view of an illustrative snow ski, snowboard and accessory storage device, with the snow skis supported by the backing arms, respectively, of the device, and the backing arms deployed in a engaged position.

Referring next to FIG. 8 of the drawings, the backing plate 12 of the device 10 may be attached to the vertical support surface at a height which is sufficient to enable the first snow ski 44 and second snow ski 46 to hang freely above a floor or other surface 50 when the first snow ski 44 and the second snow ski 46 are secured in the device 10 as was heretofore described with respect to FIGS. 5-7.

Figure 9:
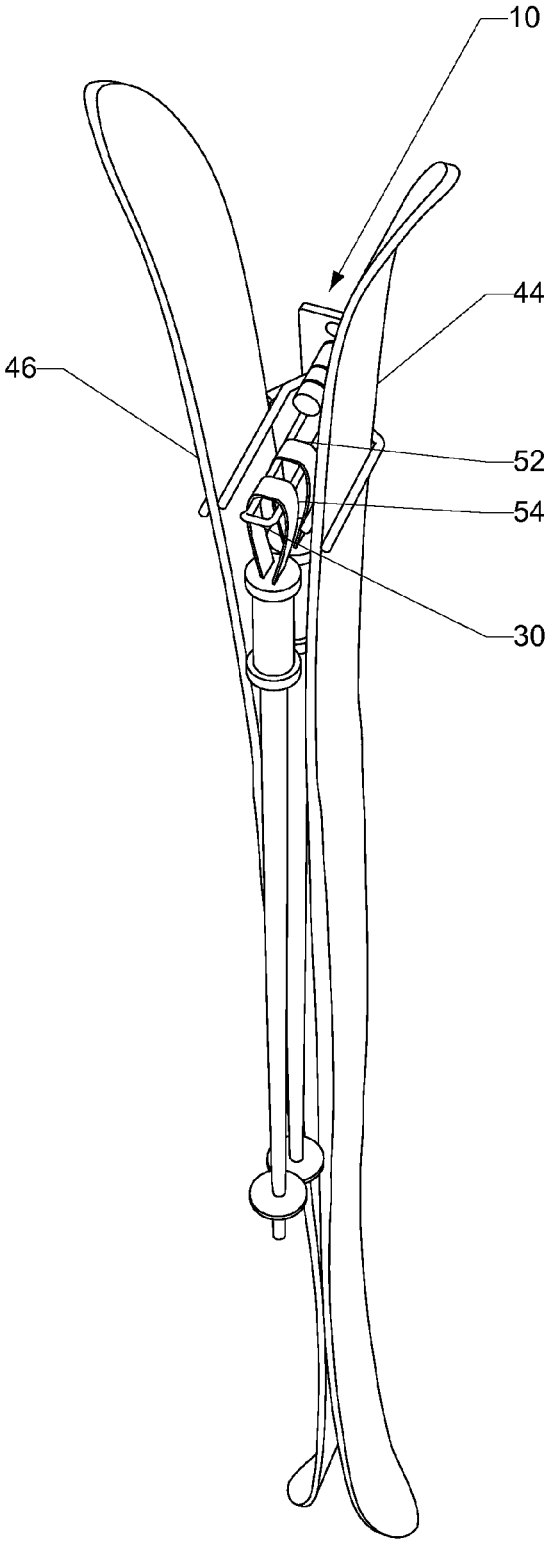
FIG. 9 is a perspective view of an illustrative snow ski, snowboard, and accessory storage device, with the snow skis supported by the backing arms, respectively, of the device, and the backing arms deployed in a engaged position.

Referring next to FIG. 9 of the drawings, a second snow ski pole 52, and a first snow ski pole 54 can be suspended from the spreader and hanging bar 30 by inserting the straps of the second and first snow ski poles 52, 54 over the spreader and hanging bar 30. The second and first snow ski poles 52, 54 may hang downwardly between the first snow ski 46 and the second snow ski 44. It will be appreciated by those skilled in the art that storage of accessories such as the second and first snow ski poles 52, 54 on the spreader and hanging bar 30 does not interfere with or prohibit storage of snow skis 44, 46 or snowboards (not illustrated) in the device 10.

It will be appreciated by those skilled in the art that the device 10 may be fabricated of metal or any other sufficiently rigid and strong material such as high strength plastics, composites and the like. Various components of the device 10 can be made of different materials. Portions of the device 10 which contact the surfaces of snow skis or snowboards may be coated and/or encapsulated with a non-abrasive finish, coating, and/or membrane to allow for a smooth and malleable surface between the snow skis or snowboards and the various components of the device 10.

It will be appreciated by those skilled in the art that the device 10 facilitates storage of snow skis, snowboards and related accessories without altering the natural shape and camber of the snow skis or snowboard. Due to the particular characteristics of the device 10, snow skis and snowboards which do not have traditional shape and/or camber can be stored just as quickly and easily as traditionally-shaped snow skis and snowboards. The inherent design of the device 10 does not rely on the compression of snow skis and snowboards into one another to achieve the forces necessary for storage. Rather, the device 10 utilizes the natural properties of the snow skis and/or snowboards to create the forces that support the snow skis and snowboards in the device 10 in a manner that does not affect the shape and/or camber of the stored snow skis and snowboards. Moreover, the design of the device 10 may isolate the stored snow skis and snowboards from one another, allowing for storage of a single snow ski or snowboard. This capability may not be possible using conventional snow ski and snowboard storage devices which rely on compression of the snow skis or snowboards against each other for storage. In addition to storing snow skis and snowboards, the device 10 also allows users to store accessories associated with the activities of skiing and snowboarding such as snow ski poles, snow ski straps, goggles and the like.

While the embodiments of the disclosure have been described above, it will be recognized and understood that various modifications can be made and the appended claims are intended to cover all such modifications which may fall within the spirit and scope of the disclosure.

What is claimed is:

1. A snow ski, snowboard and accessory storage device, comprising:

a backing plate;

a hinge assembly carried by the backing plate, the hinge assembly including at least one hinge rotatable with respect to the backing plate;

at least one backing arm carried by the at least one hinge of the hinge assembly, the at least one backing arm having an outer arm segment and an inner arm segment spaced-apart and parallel to the outer arm segment;

the at least one backing arm adapted to receive a snow ski or snowboard between the outer arm segment and the inner arm segment; and a spreader and hanging bar carried by the backing plate beneath and in spaced-apart relationship to the hinge assembly, the at least one backing arm normally resting by gravity against the spreader and hanging bar and capable of being raised from the spreader and hanging bar to completely disengage the spreader and hanging bar as the at least one hinge rotates relative to the backing plate.

2. The device of claim 1 wherein the at least one hinge comprises a pair of hinges independently rotatable with respect to the backing plate and the at least one backing arm comprises a pair of backing arms normally resting by gravity against opposite sides of the spreader and hanging bar.

3. The device of claim 1 wherein the hinge assembly comprises a hinge shaft carried by the backing plate and wherein the at least one hinge is rotatably carried by the hinge shaft.

4. The device of claim 3 wherein the at least one hinge comprises an inner hinge carried by the hinge shaft and an outer hinge carried by the hinge shaft adjacent to the inner hinge.

5. The device of claim 4 further comprising a inner washer between the backing plate and the inner hinge and a middle washer between the inner hinge and the outer hinge.

6. The device of claim 5 further comprising a hinge cap carried by the hinge shaft and a outer washer between the outer hinge and the hinge cap.

7. The device of claim 1 further comprising multiple fastener openings in the backing plate.

8. The device of claim 1 wherein the at least one backing arm has a longitudinal axis generally parallel to a longitudinal axis of the hinge assembly.

9. A snow ski, snowboard and accessory storage device, comprising:

a backing plate;

a hinge assembly carried by the backing plate, the hinge assembly including at least one hinge rotatable with respect to the backing plate;

at least one backing arm carried by the at least one hinge of the hinge assembly, the at least one backing arm having a main arm segment extending outwardly from the at least one hinge, an elongated outer arm segment extending generally perpendicularly from the main arm segment and an elongated inner arm segment extending generally perpendicularly from the main arm segment in parallel, spaced-apart relationship to the inner arm segment, the outer arm segment and the inner arm segment independently attached to the main arm segment at separate attachment points;

the at least one backing arm adapted to receive a snow ski or snowboard between the outer arm segment and the inner arm segment; and a spreader and hanging bar carried by the backing plate beneath and in spaced-apart relationship to the hinge assembly, the at least one backing arm normally resting by gravity against the spreader and hanging bar and the at least one backing arm capable of being raised from the spreader and hanging bar to completely disengage the spreader and hanging bar as the at least one hinge rotates relative to the backing plate.

10. The device of claim 9 wherein the at least one hinge comprises a pair of hinges independently rotatable with respect to the backing plate and the at least one backing arm comprises a pair of backing arms normally resting by gravity against opposite sides of the spreader and hanging bar.

11. The device of claim 9 wherein the hinge assembly comprises a hinge shaft carried by the backing plate and wherein the at least one hinge is rotatably carried by the hinge shaft.

12. The device of claim 11 wherein the at least one hinge comprises an inner hinge carried by the hinge shaft and an outer hinge carried by the hinge shaft adjacent to the inner hinge.

13. The device of claim 12 further comprising a inner washer between the backing plate and the inner hinge and a middle washer between the inner hinge and the outer hinge.

14. The device of claim 13 further comprising a hinge cap carried by the hinge shaft and a outer washer between the outer hinge and the hinge cap.

15. The device of claim 9 further comprising multiple fastener openings in the backing plate.

16. The device of claim 9 wherein the outer arm segment and the inner arm segment of the at least one backing arm each has a longitudinal axis generally parallel to a longitudinal axis of the hinge assembly.

17. A snow ski, snow board and accessory storage device, comprising:

a backing plate;

a hinge assembly carried by the backing plate, the hinge assembly including a hinge shaft extending generally perpendicularly from the backing plate, a generally cylindrical inner hinge rotatably carried by the hinge shaft and a generally cylindrical outer hinge rotatably carried by the hinge shaft;

a first backing arm carried by the outer hinge of the hinge assembly, the first backing arm having a first main arm segment extending outwardly from the outer hinge, an elongated first outer arm segment extending generally perpendicularly from the first main arm segment and an elongated first inner arm segment extending generally perpendicularly from the first main arm segment parallel, spaced-apart relationship to the first inner arm segment, the first outer arm segment and the first inner arm segment independently attached to the first main arm segment at separate first outer arm segment and first inner arm segment attachment points, respectively;

the first backing arm adapted to receive a snow ski or snowboard between the first outer arm segment and the first inner arm segment;

a second backing arm carried by the inner hinge of the hinge assembly, the second backing arm having a second main arm segment extending outwardly from the inner hinge, an elongated second outer arm segment extending generally perpendicularly from the second main arm segment and an elongated second inner arm segment extending generally perpendicularly from the second main arm segment parallel, spaced-apart relationship to the second inner arm segment, the second outer arm segment and the second inner arm segment independently attached to the second main arm segment at separate second outer arm segment and second inner arm segment attachment points, respectively;

the second backing arm adapted to receive a snow ski or snowboard between the second outer arm segment and the second inner arm segment; and a spreader and hanging bar carried by the backing plate beneath and in spaced-apart relationship to the hinge assembly, the first backing arm normally resting by gravity against a first side of the spreader and hanging bar and the first backing arm capable of being raised from the spreader and hanging bar to completely disengage the spreader and hanging bar as the inner hinge rotates relative to the backing plate and the second backing arm normally resting by gravity against a second side of the spreader and hanging bar and the second backing arm capable of being raised from the spreader and hanging bar to completely disengage the spreader and hanging bar as the outer hinge rotates relative to the backing plate.

18. The device of claim 17 wherein the spreader and hanging bar comprises a pair of generally elongated, parallel, spaced-apart main bar segments carried by the backing plate.

19. The device of claim 18 further comprising a pair of terminal bar segments extending at an angle from the main bar segments, respectively.

20. The device of claim 19 further comprising a transverse bar segment connecting the terminal bar segments.

* * * * *